US008773027B2

(12) United States Patent
Pan

(10) Patent No.: US 8,773,027 B2
(45) Date of Patent: Jul. 8, 2014

(54) CURRENT-SHUNTING ALTERNATING CURRENT LIGHT-EMITTING DIODE DRIVING CIRCUIT

(75) Inventor: Cheng-Hung Pan, Taipei (TW)

(73) Assignee: Luxul Technology Incorporation, Taipei (TW)

( * ) Notice: Subject to any disclaimer, the term of this patent is extended or adjusted under 35 U.S.C. 154(b) by 180 days.

(21) Appl. No.: 13/614,780

(22) Filed: Sep. 13, 2012

(65) Prior Publication Data

US 2013/0082617 A1 Apr. 4, 2013

(30) Foreign Application Priority Data

Sep. 30, 2011 (TW) ..... 100135501 A

(51) Int. Cl.
*H05B 37/00* (2006.01)
*H05B 37/02* (2006.01)
*H05B 33/08* (2006.01)

(52) U.S. Cl.
CPC ..... *H05B 33/089* (2013.01); *H05B 33/0821* (2013.01)
USPC ..... 315/201; 315/297; 315/307

(58) Field of Classification Search
USPC ..... 315/201, 121, 186, 224, 294, 297, 307
See application file for complete search history.

(56) References Cited

U.S. PATENT DOCUMENTS

2008/0297062 A1* 12/2008 Otake et al. ..... 315/224
2011/0140616 A1* 6/2011 Yan et al. ..... 315/186
2012/0217878 A1* 8/2012 Lin et al. ..... 315/122

* cited by examiner

*Primary Examiner* — Daniel D Chang
(74) *Attorney, Agent, or Firm* — Birch, Stewart, Kolasch & Birch, LLP

(57) ABSTRACT

A current-shunting AC LED driving circuit has a rectification unit, an LED unit, a voltage-controlled transistor, a shunt resistor, a current detection unit and a steady current control unit. The LED unit and the rectification unit constitute a power loop and acquire a pulsed DC power through the rectification unit. The voltage-controlled transistor and the current detection unit are serially connected to the power loop. The steady current control unit acquires an average loop current through the current detection unit to control the voltage-controlled transistor so that the LED unit can stably emit light. The shunt resistor is parallelly connected to the voltage-controlled transistor to constitute a current-shunting path to shunt the loop current flowing through the voltage-controlled transistor so as to reduce the power withstood by the voltage-controlled transistor.

14 Claims, 3 Drawing Sheets

CURRENT-SHUNTING ALTERNATING CURRENT LIGHT-EMITTING DIODE DRIVING CIRCUIT

BACKGROUND OF THE INVENTION

1. Field of the Invention

The present invention relates to an alternating current (AC) light-emitting diode (LED) driving circuit and more particularly to a current-shunting AC LED driving circuit adapted to conventional AC power sockets and mitigating the high-temperature drawback.

2. Description of the Related Art

LED is one of the most common lighting devices in the current market. In contrast to conventional incandescent bulbs, LED is characterized by high lighting efficiency and economical power consumption. Due to the nature of allowing current to flow in only one direction, LED is hard to receive power from conventional AC power sockets. In this regard, LED manufacturers have developed an AC LED driving circuit. With reference to FIG. 5, the AC LED driving circuit has a rectification unit 20, an LED unit 21, a voltage-controlled transistor 22, a current detection unit 23, a low-pass filter 24 and a steady current control unit 25.

The rectification unit 20 has an input terminal connected to an AC power source, converts the AC power into a pulsed DC power and outputs the pulsed DC power.

The LED unit 21 has multiple LEDs and electrically connected to an output terminal of the rectification unit 20 to constitute a power loop.

The voltage-controlled transistor 22 is serially connected to the power loop and has a control terminal for adjusting a loop current of the power loop.

The current detection unit 23 is serially connected to the power loop to convert the loop current of the power loop into a corresponding voltage signal.

The low-pass filter 24 is electrically connected to the current detection unit 23 and outputs an average voltage according to the voltage signal converted by the current detection unit 23.

The steady current control unit 25 has an input terminal electrically connected to the low-pass filter 24, another input terminal electrically connected to a reference voltage and an output terminal electrically connected to the control terminal of the voltage-controlled transistor 22. The steady current control unit 25 compares the reference voltage value received by the input terminal thereof with the average voltage value, and outputs a control signal based on the comparison result to stabilize the loop current of the power loop.

The rectification unit 20 serves to convert the inapplicable AC power into the pulsed DC power. The current detection unit 23 and the low-pass filter 24 detect the average value of the loop current flowing through the LED unit 21. The steady current control unit 25 controls the loop current adjusted by the voltage-controlled transistor 22 to supply power to the LED unit 21 for sustaining uniform lighting.

The voltage-controlled transistor 22 is serially connected to the overall power loop so as to control the loop current. Hence, the loop current completely flows through the voltage-controlled transistor 22 to cause constant high power consumed by the voltage-controlled transistor 22. When normally operated, the voltage-controlled transistor 22 needs to be stably operated at a current of 0.16 amps and withstand a voltage in a range of 5~25 volts. Standardized by the normal operation condition, the voltage-controlled transistor should be subject to a power in a range of 0.8~4.0 W. Such power range overwhelms any transistor in the market without exception and introduces extraordinary load to an integrated circuit especially when the voltage-controlled transistor, the low-pass filter and the steady current control unit are integrated in the integrated circuit. When the voltage-controlled transistor is subject to the power in the range of 0.8~4.0 W and a temperature of the voltage-controlled transistor suddenly rises to 150° C. within few minutes, the integrated circuit with the voltage-controlled transistor thereon surely fails to be operated normally.

SUMMARY OF THE INVENTION

An objective of the present invention is to provide a current-shunting AC LED driving circuit adapted to conventional AC power sockets and mitigating the high-temperature drawback.

To achieve the foregoing objective, the current-shunting AC LED driving circuit has a rectification unit, an LED unit, a voltage-controlled transistor, a shunt resistor, a current detection unit, a low-pass filter and a steady current control unit.

The rectification unit has an output terminal and an input terminal. The input terminal is adapted to connect to an AC power source for the rectification unit to convert the AC power into a pulsed DC power and output the pulsed DC power from the output terminal of the rectification unit.

The LED unit has multiple LEDs and is connected to the output terminal of the rectification unit to constitute a power loop.

The voltage-controlled transistor is serially connected to the power loop and has a control terminal for adjusting a loop current flowing through the power loop.

The shunt resistor is parallelly connected to the voltage-controlled transistor and has a resistance value in a range with a lower bound not less than a value of a maximum operating voltage of the voltage-controlled transistor divided by a rated current defined as the loop current when the voltage-controlled transistor is cut off and an upper bound not greater than a value of dividing the maximum operating voltage by a current difference value obtained by a difference between the rated current and a value of dividing a peak power withstood by the voltage-controlled transistor by the maximum operating voltage.

The current detection unit is serially connected to the power loop and converts the loop current of the power loop into a corresponding voltage signal.

The low-pass filter is connected to the current detection unit and outputs an average voltage according to the voltage signal converted by the current detection unit.

The steady current control unit has two input terminals and an output terminal. One of the input terminals is connected to an output terminal of the low-pass filter and the other input terminal is connected to a reference voltage. The output terminal is connected to the control terminal of the voltage-controlled transistor. The steady current control unit compares a value of the average voltage outputted by the low-pass filter with a value of the received reference voltage, and outputs a control signal to the control terminal of the voltage-controlled transistor according to the comparison result so as to stabilize the loop current of the power loop.

The present invention employs the shunt resistor parallelly connected to the voltage-controlled transistor so as to shunt the loop current originally flowing through the voltage-controlled transistor through the shunt resistor. The resistance value of the shunt resistor is chosen within a range of the minimum operating current of the voltage-controlled transistor and the peak power withstood by the voltage-controlled transistor to reduce the loop current flowing through the voltage-controlled transistor, thereby lowering the power withstood by the voltage-controlled transistor. Accordingly, the present invention can be applicable to conventional AC power sockets and is free of the issue that the voltage-controlled transistor fails to normally function due to temperature rise thereof.

Other objectives, advantages and novel features of the invention will become more apparent from the following detailed description when taken in conjunction with the accompanying drawings.

DETAILED DESCRIPTION OF THE INVENTION

Figure 1:
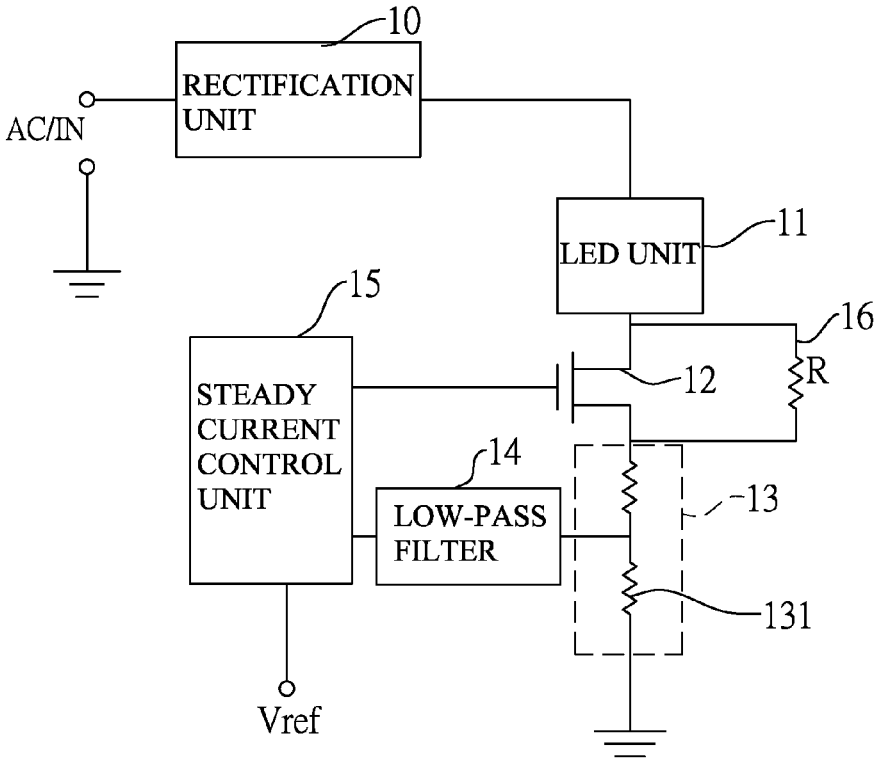
FIG. 1 is a circuit diagram of a current-shunting AC LED driving circuit in accordance with the present invention.

With reference to FIG. 1, a current-shunting AC LED driving circuit in accordance with the present invention has a rectification unit 10, an LED unit 11, a voltage-controlled transistor 12, a current detection unit 13, a low-pass filter 14, a steady current control unit 15 and a shunt resistor 16.

The rectification unit 10 has an input terminal and an output terminal. The input terminal of the rectification unit 10 is connected to an AC power source for the rectification unit 10 to convert the AC power into a pulsed DC power and output the pulsed DC power from the output terminal of the rectification unit 10. The rectification unit 10 may be a full wave rectification circuit or a half wave rectification circuit. In the present embodiment, the rectification unit 10 is a full wave rectification circuit.

The LED unit 11 has multiple LEDs connected in series, in parallel or in series-parallel, and is further connected to the output terminal of the rectification unit 10 to constitute a power loop so that the pulsed DC power outputted by the rectification unit 10 can drive the LED unit 11 to emit light.

The voltage-controlled transistor 12 is serially connected to the power loop constituted by the LED unit 11 and the rectification unit 10, and has a control terminal for adjusting a loop current flowing through the power loop. The voltage-controlled transistor 12 may be a metal-oxide-semiconductor field effect transistor (MOSFET) or a junction effect transistor (JFET). In the present embodiment, the voltage-controlled transistor 12 is a MOSFET, the gate thereof is the control terminal, and the drain and source thereof are serially connected to the power loop. A control voltage between the gate and the source of the voltage-controlled transistor 12 is used to adjust a loop current $I_{MOS}$ between the drain and the source of the voltage-controlled transistor 12.

The current detection unit 13 is serially connected to the voltage-controlled transistor 12, and the current detection unit 13 and the voltage-controlled transistor 12 are jointly connected in series to the power loop constituted by the LED unit 11 and the rectification unit 10. In the present embodiment, the current detection unit 13 has a detection resistor 131 for detecting a voltage signal in response to the loop current of the power loop.

An input terminal of the low-pass filter 14 is connected to a node serially connected to the voltage-controlled transistor 12 and the current detection unit 13 to receive an average voltage in response to an average of the loop current. The low-pass filter 14 may be an analog filter composed of capacitors and inductors or a digital filter composed of digital circuit, and is a digital filter in the present embodiment. The digital filter is a down-sampling filter, which oversamples a received voltage signal and outputs an average voltage after converting the voltage signal to respond to the average of the loop current flowing through the power loop.

The steady current control unit 15 has two input terminals and an output terminal. One of the input terminals is connected to an output terminal of the low-pass filter 14, the output terminal is connected to the control terminal of the voltage-controlled transistor 12, and a reference voltage is inputted to the other input terminal. The steady current control unit 15 compares the average voltage outputted by the low-pass filter 14 with the received reference voltage. If the average voltage is greater than the reference voltage, the steady current control unit outputs a control signal to the control terminal of the voltage-controlled transistor 12 to decrease the power of the power loop, and if the average voltage is less than the reference voltage, the steady current control unit outputs a control signal to the control terminal of the voltage-controlled transistor 12 to increase the power of the power loop, so that the loop current of the power loop can be stabilized.

Figure 2:
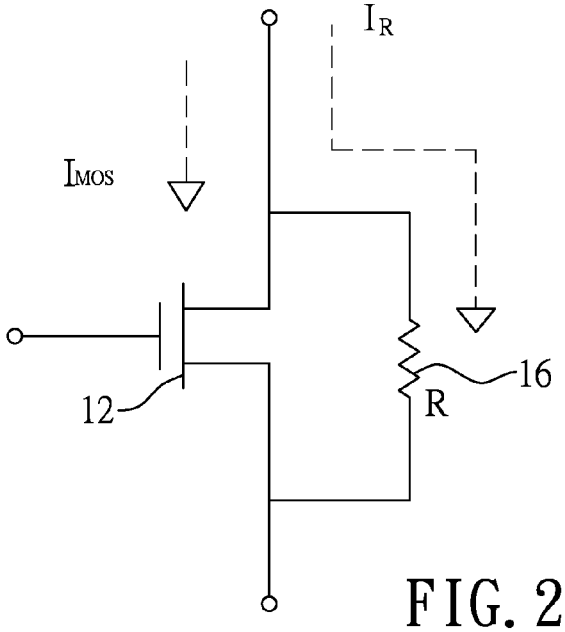
FIG. 2 is an enlarged circuit diagram of the current-shunting AC LED driving circuit in FIG. 1.

With reference to FIG. 2, the shunt resistor 16 is parallelly connected to the voltage-controlled transistor 12 and is parallelly connected between the drain and the source of the voltage-controlled transistor 12. To ensure that the voltage-controlled transistor 12 parallelly connected to the shunt resistor 16 functions normally, a maximum current $I_R$ flowing through the shunt resistor 16 should be less than a rated current of the voltage-controlled transistor 12. The rated current is defined to be the loop current when the voltage-controlled transistor is cut off. The maximum current IR flowing through the shunt resistor 16 is determined by a maximum operating voltage of the voltage-controlled transistor 12 and the resistance value of the shunt resistor 16. The resistance value of the shunt resistor 16 should not be less than a value of the maximum operating voltage divided by the rated current. To cope with the overheated issue of the voltage-controlled transistor 12, the maximum current $I_R$ flowing through the shunt resistor 16 should be maintained at a magnitude without loosing its function. Hence, the maximum current $I_R$ flowing through the shunt resistor 16 should be greater than a value obtained by subtracting the current $I_{MOS}$ flowing through the voltage-controlled transistor 12 when the voltage-controlled transistor 12 is operated at its peak power from the rated current. The current $I_{MOS}$ at the peak power is a value of the peak power withstood by the voltage-controlled transistor 12 divided by the maximum operating voltage. As the voltage across the shunt resistor 16 is the same as the voltage across the voltage-controlled transistor 12, a current flowing through the shunt resistor 16 is equal to a value of the maximum operating voltage divided by the resistance value of the shunt resistor 16. The resistance value of the shunt resistor 16 should not be greater than a value of dividing the maximum operating voltage by a current difference value obtained by a difference between the rated current and a value of dividing the peak power withstood by the voltage-controlled transistor 12 by the maximum operating voltage.

As mentioned in the foregoing description, the shunt resistor 16 is parallelly connected to the voltage-controlled transistor to form a current shunting path so as to reduce the power withstood by the voltage-controlled transistor 12. As far as current operation of the AC LED driving circuit is concerned, suppose that the voltage-controlled transistor 12 must withstand 5~25 volts and the maximum withstanding power is 1 W when the power loop of the AC LED driving circuit needs to be stably operated at 0.16 amp. The resistance value of the shunt resistor 16 needs to be selected in a range of 156Ω~208Ω.

Figure 3:
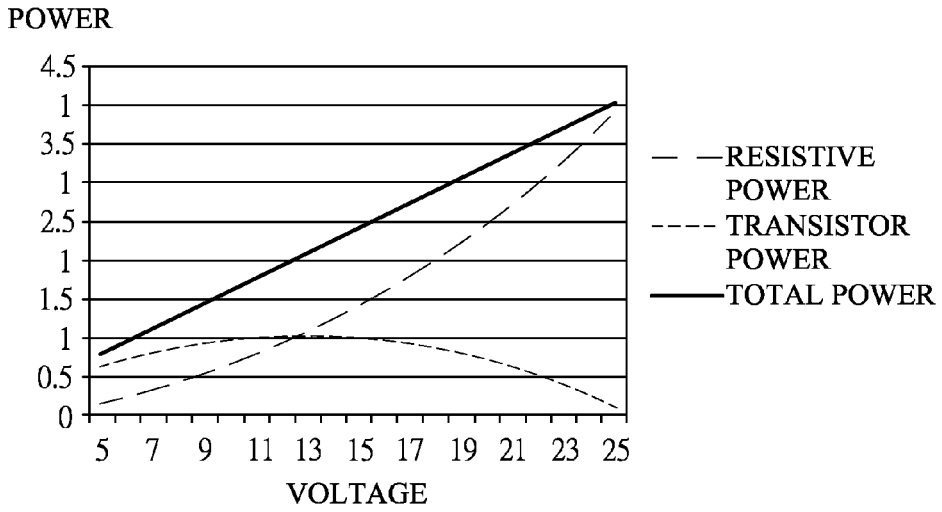
FIG. 3 is a curve graph showing power distribution of a voltage-controlled transistor of the current-shunting AC LED driving circuit in FIG. 1.

With reference to FIG. 3, a curve graph illustrates the power distribution of the voltage-controlled transistor after the shunt resistor is selected to be 160Ω. The power distribution shows that the power of the voltage-controlled transistor 12 can be always maintained under the peak power withstood by the voltage-controlled transistor 12 when the operating voltage increases.

Figure 4:
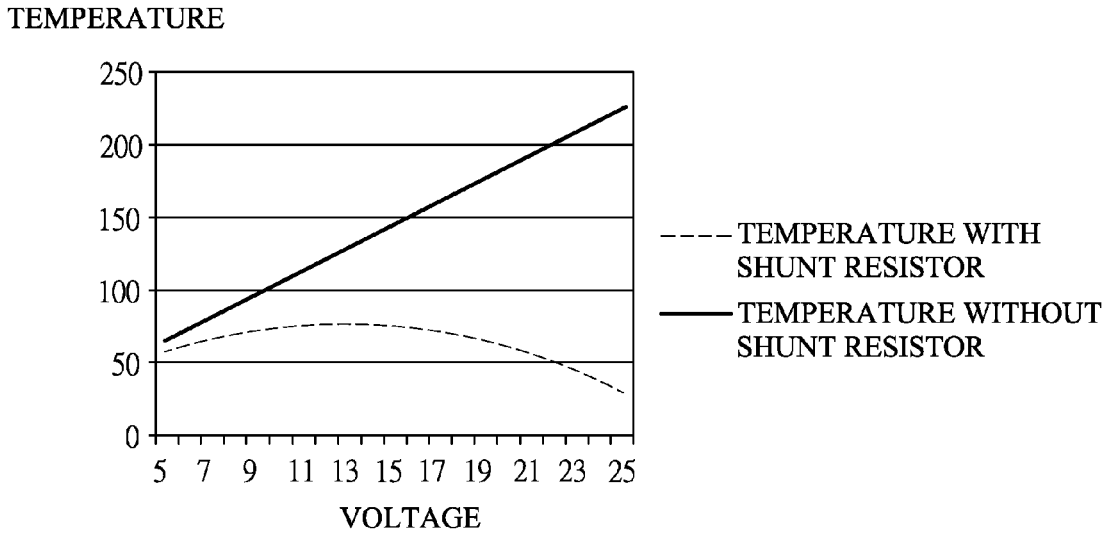
FIG. 4 is a curve graph showing temperature versus operating power obtained from the voltage-controlled transistor in the current-shunting AC LED driving circuit in FIG. 1.
Figure 5:
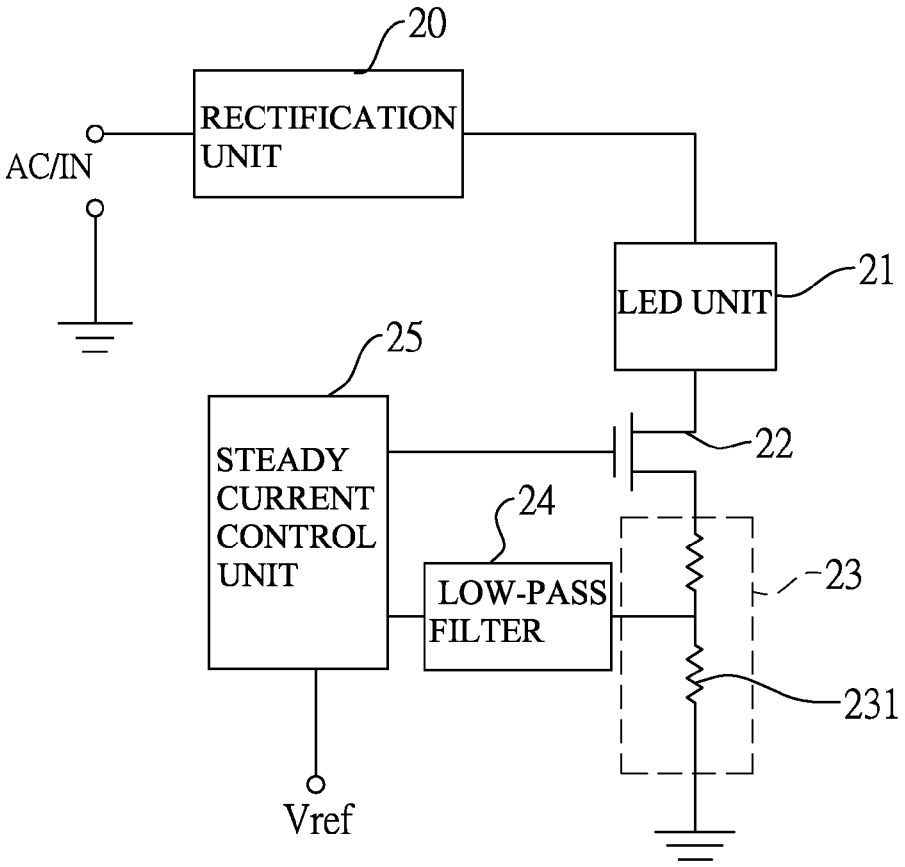
FIG. 5 is a circuit diagram of a conventional AC LED driving circuit.

With reference to FIG. 4, suppose that a temperature coefficient is 50° C./W, and the curve graph illustrates temperature variations of the voltage-controlled transistor with and without the shunt resistor. As illustrated, when the shunt resistor 16 is provided and the operating voltage increases, the temperature of the voltage-controlled transistor 12 can be always maintained under 80° C. However, when the shunt resistor 16 is absent and the operating voltage increases, the temperature of the voltage-controlled transistor 12 can easily exceed 100° C. and even exceed 150° C.

In sum, the addition of the shunt resistor can reduce the peak power withstood by the voltage-controlled transistor, thereby preventing the voltage-controlled transistor from withstanding large power. The overheated issue that the temperature of the voltage-controlled transistor will rise up to 150° C. within few minutes can be avoided and normal operation of the voltage-controlled transistor can be ensured.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A current-shunting alternating current (AC) light-emitting diode (LED) driving circuit comprising:

a rectification unit having:

an output terminal; and an input terminal adapted to connect to an AC power source for the rectification unit to convert the AC power into a pulsed DC power and output the pulsed DC power from the output terminal of the rectification unit;

an LED unit having multiple LEDs and connected to the output terminal of the rectification unit to constitute a power loop;

a voltage-controlled transistor serially connected to the power loop and having a control terminal for adjusting a loop current flowing through the power loop;

a shunt resistor parallelly connected to the voltage-controlled transistor and having a resistance value in a range with a lower bound not less than a value of a maximum operating voltage of the voltage-controlled transistor divided by a rated current defined as the loop current when the voltage-controlled transistor is cut off and an upper bound not greater than a value of dividing the maximum operating voltage by a current difference value obtained by a difference between the rated current and a value of dividing a peak power withstood by the voltage-controlled transistor by the maximum operating voltage;

a current detection unit serially connected to the power loop and converting the loop current of the power loop into a corresponding voltage signal;

a low-pass filter connected to the current detection unit and outputting an average voltage according to the voltage signal converted by the current detection unit; and a steady current control unit having:

two input terminals, one of the input terminals connected to an output terminal of the low-pass filter and the other input terminal connected to a reference voltage; and an output terminal connected to the control terminal of the voltage-controlled transistor; and the steady current control unit comparing a value of the average voltage outputted by the low-pass filter with a value of the received reference voltage, and outputting a control signal to the control terminal of the voltage-controlled transistor according to the comparison result so as to stabilize the loop current of the power loop.

2. The AC LED driving circuit as claimed in claim 1, wherein the current detection unit has a detection resistor for detecting a voltage signal in response to the loop current of the power loop.

3. The AC LED driving circuit as claimed in claim 1, wherein the low-pass filter is a digital filter.

4. The AC LED driving circuit as claimed in claim 2, wherein the low-pass filter is a digital filter.

5. The AC LED driving circuit as claimed in claim 3, wherein the digital filter is a down-sampling filter.

6. The AC LED driving circuit as claimed in claim 4, wherein the digital filter is a down-sampling filter.

7. The AC LED driving circuit as claimed in claim 1, wherein the low-pass filter is an analog filter.

8. The AC LED driving circuit as claimed in claim 2, wherein the low-pass filter is an analog filter.

9. The AC LED driving circuit as claimed in claim 1, wherein the voltage-controlled transistor is a metal-oxide-semiconductor field effect transistor (MOSFET), the drain and the source of the MOSFET are serially connected to the power loop and the gate is a control terminal.

10. The AC LED driving circuit as claimed in claim 2, wherein the voltage-controlled transistor is a MOSFET, the drain and the source of the MOSFET are serially connected to the power loop and the gate is a control terminal.

11. The AC LED driving circuit as claimed in claim 3, wherein the voltage-controlled transistor is a MOSFET, the drain and the source of the MOSFET are serially connected to the power loop and the gate is a control terminal.

12. The AC LED driving circuit as claimed in claim 4, wherein the voltage-controlled transistor is a MOSFET, the drain and the source of the MOSFET are serially connected to the power loop and the gate is a control terminal.

13. The AC LED driving circuit as claimed in claim 5, wherein the voltage-controlled transistor is a MOSFET, the drain and the source of the MOSFET are serially connected to the power loop and the gate is a control terminal.

14. The AC LED driving circuit as claimed in claim 6, wherein the voltage-controlled transistor is a MOSFET, the drain and the source of the MOSFET are serially connected to the power loop and the gate is a control terminal.

* * * * *